US009782016B2

(12) United States Patent
Aramli

(10) Patent No.: US 9,782,016 B2
(45) Date of Patent: Oct. 10, 2017

(54) BEDDING CLIMATE CONTROL APPARATUS WITH FORCED AIRFLOW FOR HEATING AND VENTILATING

(71) Applicant: Mark Aramli, Newport, RI (US)

(72) Inventor: Mark Aramli, Newport, RI (US)

( * ) Notice: Subject to any disclaimer, the term of this patent is extended or adjusted under 35 U.S.C. 154(b) by 165 days.

(21) Appl. No.: 14/534,494

(22) Filed: Nov. 6, 2014

(65) Prior Publication Data

US 2015/0121620 A1 May 7, 2015

Related U.S. Application Data

(63) Continuation-in-part of application No. 29/501,652, filed on Sep. 5, 2014, now Pat. No. Des. 750,858, and a continuation-in-part of application No. 29/501,656, filed on Sep. 5, 2014, now abandoned, and a continuation-in-part of application No. 29/501,647, filed on Sep. 5, 2014, now Pat. No. Des. 733,269.

(60) Provisional application No. 61/966,042, filed on Nov. 6, 2013.

(51) Int. Cl.

| | |
|---|---|
| ***F24H 3/02*** | (2006.01) |
| ***F24D 15/02*** | (2006.01) |
| ***A47C 21/04*** | (2006.01) |

(52) U.S. Cl.

CPC ..... *A47C 21/044* (2013.01); *A47C 21/048* (2013.01)

(58) Field of Classification Search

None

See application file for complete search history.

(56) References Cited

U.S. PATENT DOCUMENTS

| | | | | | |
|---|---|---|---|---|---|
| 2,560,349 | A * | 7/1951 | Inglis | A47C 21/044 | 219/217 |
| 3,230,556 | A * | 1/1966 | Shippee | A47C 21/044 | 392/379 |
| 3,444,922 | A * | 5/1969 | Dingman | A61H 35/00 | 165/247 |
| 4,939,804 | A * | 7/1990 | Grant | A47C 21/044 | 5/423 |
| 5,578,230 | A * | 11/1996 | Eldon | A47G 9/0215 | 219/211 |
| 5,730,120 | A * | 3/1998 | Yonkers, Jr. | A47C 21/048 | 128/202.13 |
| 6,210,428 | B1 * | 4/2001 | Augustine | A47G 9/0215 | 607/104 |
| 6,473,920 | B2 * | 11/2002 | Augustine | A61F 7/00 | 5/421 |

(Continued)

OTHER PUBLICATIONS

Chili Technology—user manual—www.chilitechnology.com.au.

*Primary Examiner* — Thor Campbell

(74) *Attorney, Agent, or Firm* — Robert J. Hess; Hess Patent Law Firm

(57) ABSTRACT

A bedding climate control apparatus that delivers, in a quiet manner, forced airflow from a fan/blower within a housing to selectively deliver tempered (heated via a thermal element) and untempered (room temperature) air through a flexible hose to bedding. The quiet manner is attained with acoustic foam in the path of incoming airflow to the fan/blower and by oversizing each of the components that create a pressure drop including the capacity of the fan/blower over what is needed to deliver a required amount of airflow. Temperature may be set remotely via a wireless remote control and via a Bluetooth enabled device.

22 Claims, 9 Drawing Sheets

(56) References Cited

U.S. PATENT DOCUMENTS 6,524,332 B1 * 2/2003 Augustine ..... A47G 9/0215 607/104
6,701,552 B2 * 3/2004 Suzuki ..... F24H 3/0405 5/421
6,711,767 B2 * 3/2004 Klamm ..... A47C 21/048 5/423
7,036,163 B2 * 5/2006 Schmid ..... A47C 21/044 5/421
7,120,951 B2 * 10/2006 Augustine ..... A61F 7/00 5/421
7,631,377 B1 * 12/2009 Sanford ..... A47C 21/044 5/413 R
7,908,688 B2 * 3/2011 Tompkins ..... A47C 21/048 454/192
7,913,332 B1 * 3/2011 Barnhart ..... A47C 21/044 5/421
8,332,975 B2 * 12/2012 Brykalski ..... A47C 21/044 5/421
8,353,069 B1 * 1/2013 Miller ..... A47C 21/044 5/421
9,192,244 B2 * 11/2015 Rand ..... A47C 21/044
2003/0036786 A1 * 2/2003 Duren ..... A47C 21/04 607/96
2003/0140418 A1 * 7/2003 Klamm ..... A47C 21/048 5/423
2006/0085911 A1 * 4/2006 Tompkins ..... A47C 21/048 5/423
2008/0060131 A1 * 3/2008 Tompkins ..... A47C 21/048 5/423
2010/0221994 A1 * 9/2010 Tompkins ..... F24F 9/00 454/251
2015/0121619 A1 * 5/2015 Aramli ..... A47C 21/048 5/423
2015/0121621 A1 * 5/2015 Aramli ..... A47C 21/044 5/423

* cited by examiner

BEDDING CLIMATE CONTROL APPARATUS WITH FORCED AIRFLOW FOR HEATING AND VENTILATING

CROSS-REFERENCE TO COPENDING PATENT APPLICATIONS

This patent application asserts the benefit of invention priority from the filing on Nov. 6, 2013 of U.S. provisional patent application No. 61/966,042 entitled "Forced air thermal device for a bed with integrated wireless RF remote controls and optional wi-fi/Bluetooth controls". The patent application is a continuation-in-part of U.S. design patent application Ser. No. 29/501,652 filed Sep. 5, 2014 entitled "AIR DELIVERY OUTLET NOZZLE", U.S. design patent application Ser. No. 29/501,656 filed Sep. 5, 2014 and entitled "HOUSING FOR A CLIMATE CONTROL APPARATUS" and U.S. design patent application Ser. No. 29/501,647 filed Sep. 5, 2014 and entitled "SLEEVED HOSE".

INCORPORATION BY REFERENCE

This patent application incorporates subject matter by reference to copending patent applications of the same inventor as that of the present application:

(1) U.S. provisional patent application No. 61/966,042 entitled "Forced air thermal device for a bed with integrated wireless RF remote controls and optional wi-fi/Bluetooth controls.
(2) U.S. design patent application Ser. No. 29/501,652 filed Sep. 5, 2014 entitled "AIR DELIVERY OUTLET NOZZLE"
(3) U.S. design patent application Ser. No. 29/501,656 filed Sep. 5, 2014 and entitled "HOUSING FOR A CLIMATE CONTROL APPARATUS"
(4) U.S. design patent application Ser. No. 29/501,647 filed Sep. 5, 2014 and entitled "SLEEVED HOSE".
(5) U.S. utility patent application filed in Nov. 6, 2014 and entitled "REMOTE SETTING AND OPERATION OF A BEDDING CLIMATE CONTROL APPARATUS WITH FORCED AIRFLOW FOR HEATING AND VENTILATING
(6) U.S. utility patent application filed on Nov. 6, 2014 and entitled "RETENTION UNIT TO GRASP A FLEXIBLE HOSE AND CLAMP ONTO BED SHEETS AND METHODS OF MANUFACTURE AND OPERATION THEREOF".

BACKGROUND OF THE INVENTION

Technical Field of the Invention

The invention is a home appliance that provides very rapid heating of a bed via forced heated air prior to the user entering the bed, or while the user is in the bed and also provides a cooling effect after the user has entered the bed via fresh room temperature air being forced into the bedding. That is, the invention relates to supplying forced air, which may be heated, within a space between a fitted mattress sheet and a bedding sheet.

Description of Related Art

Current control of the temperature of a bed relies on electric blankets or electric mattress pads. These devices are limited in their wattage capability and typically take 30 to 45 minutes to raise the temperature of bedding by 20 degrees F. As well, they provide no means to cool the user. They also provide no circulation of fresh air into the bedding.

Some products are currently in use in the medical field that provide forced air bed heating to patients in surgical recovery rooms. These devices cannot be used without proprietary gowns with airflow channels or perforated sheets with airflow channels that must be connected to the forced air heater for distribution of the heat to the patient.

The Electric Blanket Institute finds that the average electric blanket puts out less than 200 watts of heating power, and some portion of this energy is emitted to the topside of the blanket into the bedroom.

Electric blankets have embedded wires, which one can feel and these wires can be chewed on by pets or damaged by children and sharp objects.

Many electric blankets aren't reliable after repeated washings or have very special washing and drying instructions that must be followed. The present inventor has found by observing through an IR camera that wires of a brand new blanket purchased from a major department store after 45 minutes on "Hi" setting do not provide even heating. Older electric blankets cause hundreds of fires a year from wires in the bed.

It is desired to deliver heat to bedding and sheets or to provide the sensation of cooling to a person within the bedding and sheets, all under direction from a bedside remote control. In so doing, it is desired to deliver to bedding and sheets more dry heating power than is available from electric blankets in a safe and quiet manner at a temperature that is the same as provided by a household HVAC central air-heating unit.

SUMMARY OF THE INVENTION

An aspect of the invention reside in a bedding climate control apparatus that delivers, in a exceptionally quiet manner, forced airflow from a fan/blower within a housing to selectively deliver tempered (heated via a ceramic thermal element) and untempered (room temperature) air through an air duct to bedding. The quiet manner is attained by oversizing a size of the housing to accommodate acoustic dampening material, e.g., foam, oversizing a dimension of the fan/blower, oversizing a heating capacity of the thermal element, and oversizing a dimension of an air conduit, e.g., flexible hose, beyond the size actually needed for efficient operation.

The capacity of the housing is oversized beyond that needed to accommodate just the fan/blower so that it can accommodate acoustic foam at the air intake to dampen sound generation by the fan/blower. The acoustic foam is arranged so there is no direct line of sight between the air supply and the air intake to the fan/blower, thereby forcing sound waves exiting the fan/blower to have previously deflected off the acoustic foam to thereby dampen its sound.

The capacity of the fan/blower to deliver needed airflow exceeds that necessary for attaining the desired airflow. As a result, the fan/blower is run at quieter speeds than would be the case if it were sized to efficiently deliver the needed airflow. One reason for being able to run the motor of the fan/blower at a lower speed is that the pressure drop that the airflow must overcome to reach the bedding is kept low via oversizing of other components in the air flow path.

In furtherance of this goal, a ceramic thermal element, which is used to heat or temper the air flow, is oversized so its flow capacity exceeds that necessary for the heat delivery needed. As a result, the air pressure resistance across the thermal element is reduced. The oversizing also allows the oversized thermal element to have greater surface area to heat the airflow (than can a smaller dimensioned ceramic thermal element) to have the element surface temperature reach a lower temperature than would be the case if it were smaller in dimension. This lower temperature is below the flashpoint of dust and lint, which thus do not burn when subjected to heat from the ceramic thermal element operating at the lower temperature delivery, avoiding undesirable odors associated with electric heaters If the ceramic thermal element were sized smaller it would need to operate to deliver the heat at a higher temperature in order the handle the air flow requirements for tempered airflow and would provide higher air pressure resistance requiring a higher power and thus louder fan/blower The air duct is oversized to lessen the pressure drop across it for the required airflow and thus avoid the need to run the motor of the fan/blower at a higher speed to overcome the pressure drop, which would be the case is the air duct were sized smaller to be suited to handle the full air flow volume.

A further aspect is to sense air temperature of the airflow emerging from a discharge of the blower/fan and from an air delivery outlet so as to vary a temperature of the forced air being delivered to bedding as necessary to maintain substantially a constant temperature throughout a time interval, as well as to shut off heating power in the event that the airflow temperature is to high as to risk reaching burn temperature.

Another aspect is to vary a setting of the temperature of the forced air being delivered to bedding as time passes. Still another aspect is to deliver the force air to bedding initially at a maximum temperature setting for a relatively short duration such as ten minutes to provide maximum heating and to thereafter change the temperature setting to a lower temperature for a relatively longer duration (such as overnight). Yet another aspect resides in controlling the bedding climate control apparatus with a wireless remote control unit and with a blue-tooth enabled wireless smart phone or tablet computer at the same time or at different times. The control may include commencement of forced airflow, heating of the forced airflow, setting a change in temperature of the heated forced airflow as a function of time over a time interval, recall time, temperature and air flow rate settings from memory storage, setting an alarm to automatically turn on and off the bedding climate control apparatus at specific times. The smart phone or tablet computer may work in conjunction with a software application retrieved from the internet to interact with the bedding climate control apparatus.

Still another aspect resides in delivering heating power at a level that prevents tripping a conventional electrical circuit of a household and in preventing high heat delivery from potentially burning skin of a person under certain conditions by delivering between 1000 watts of heating power to a maximum of 1500 watts of heating power inclusive and heating the forced air to a maximum temperature substantially at 48 degrees Celsius (118 degrees Fahrenheit).

An additional aspect resides in a longitudinally expandable/compressible flexible hose that keeps its interior air passage dimension intact even when longitudinally compressed and flexed to bend. The longitudinally expandable/compressible flexible hose has a steel wire wound inside to maintain the air passage dimension intact. The entire flexible hose may be sheathed within a stretchable manmade fabric such as spandex to provide insulative as well as cosmetic benefit.

Another aspect resides in the fan/blower being operated with a DC brushless motor that enables 0-100% adjustability in motor power so that airflow from the fan/blower powered by the motor permits airflow adjustment increments of as small as 5%. Thus, a user could adjust the airflow delivery volume to any of 20 settings at 5% increments from 0 to 100%. Certainly, 10 settings at 10% increments could be done instead if desired within the range of 0 to 100% power. That would still be preferable to the limited three choices available conventionally for blowers of just low, medium or high.

A further aspect resides in a bed sheet retention unit that has clamps that clamp onto a bed sheet to keep its position over the air delivery outlet nozzle. This helps to ensure that airflow will enter the space between the upper sheet and fitted mattress sheet regardless of how the occupant of the bed might move them during sleep. Since there are platform beds that have a raised lip about their periphery, the bed sheet retention unit has two horizontally disposed segments jointed to each other by a vertically disposed segment (riser), which rises to an elevation that is higher than the peripheral wall of the conventional partition bed.

Preferably, the housing of the bedding climate control apparatus should be sized to fit beneath conventional beds and thus be up to seven inches in height. Therefore the bedding climate control apparatus sits next to or under the foot of the bed and sends forced hot or cool air in between the bedding top sheet and fitted mattress sheet via the air delivery outlet nozzle, which is small and unobtrusive and is anchored at the bottom corner of the bed.

Once activated, the blower/fan, flexible hose and air delivery outlet nozzle operate at a very specific air pressure to quietly generate a small cushion of turbulent air between the upper bedding sheet and fitted mattress sheet that lifts the top bedding sheet off the fitted mattress sheet via a layer of pressurized air. This tenting effect on the bedding combined with the airflow that follows enables Climate control apparatus air to permeate throughout the entire sleeping area and provide even heating or cooling.

For heating, the bedding climate control apparatus is operated to heat three to five minutes before getting into bed to achieve a 30 degrees F. bedding pre-heat, or for short bursts while already in bed. For longer duration heating while in bed, the apparatus can be set on a lower temperature mode for gentle warming at a lower temperature set point. For cooling, the climate control apparatus emits much less noise than a room air conditioner and one may operate it while in bed.

Another aspect resides in a grille within the exhaust air passage of the/blower/fan that prevents fingers from reaching through the exhaust air passage live electrical components within the fan/blower despite the dimension of the exhaust air passage being large enough in dimension to enable fingers to fit in. This relatively larger size exhaust air passage means that the fan/blower can deliver the necessary volume of airflow with a lesser pressure drop through the air duct than would otherwise be the case if sized smaller.

BRIEF DESCRIPTION OF THE DRAWING

For a better understanding of the present invention, reference is made to the following description and accompanying drawings, while the scope of the invention is set forth in the appended claims.

DETAILED DESCRIPTION OF THE INVENTION

Figure 1:
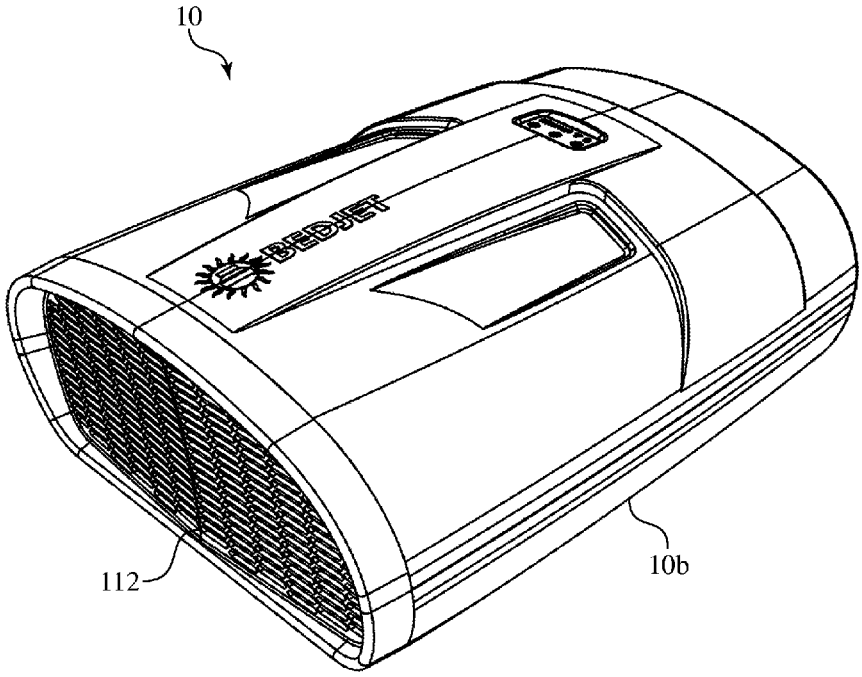
FIG. 1 is an isometric view of the bedding climate control apparatus of the invention.

Turning to the drawing, FIG. 1 shows a bedding climate control apparatus 10 is shown in accordance with the invention. The bedding climate control apparatus 10 has housing 106 that contains a fan or blower (not shown in FIG. 1) that receives air via air intake grille 112. The air may be tempered or heated with a thermal element (not shown in FIG. 1) that is contained within the housing 106 in the discharge side of the fan or blower. The structure of the housing 106 corresponds to that depicted in US design patent application Ser. No. 29/501,656, whose contents are incorporated herein by reference.

Figure 2:
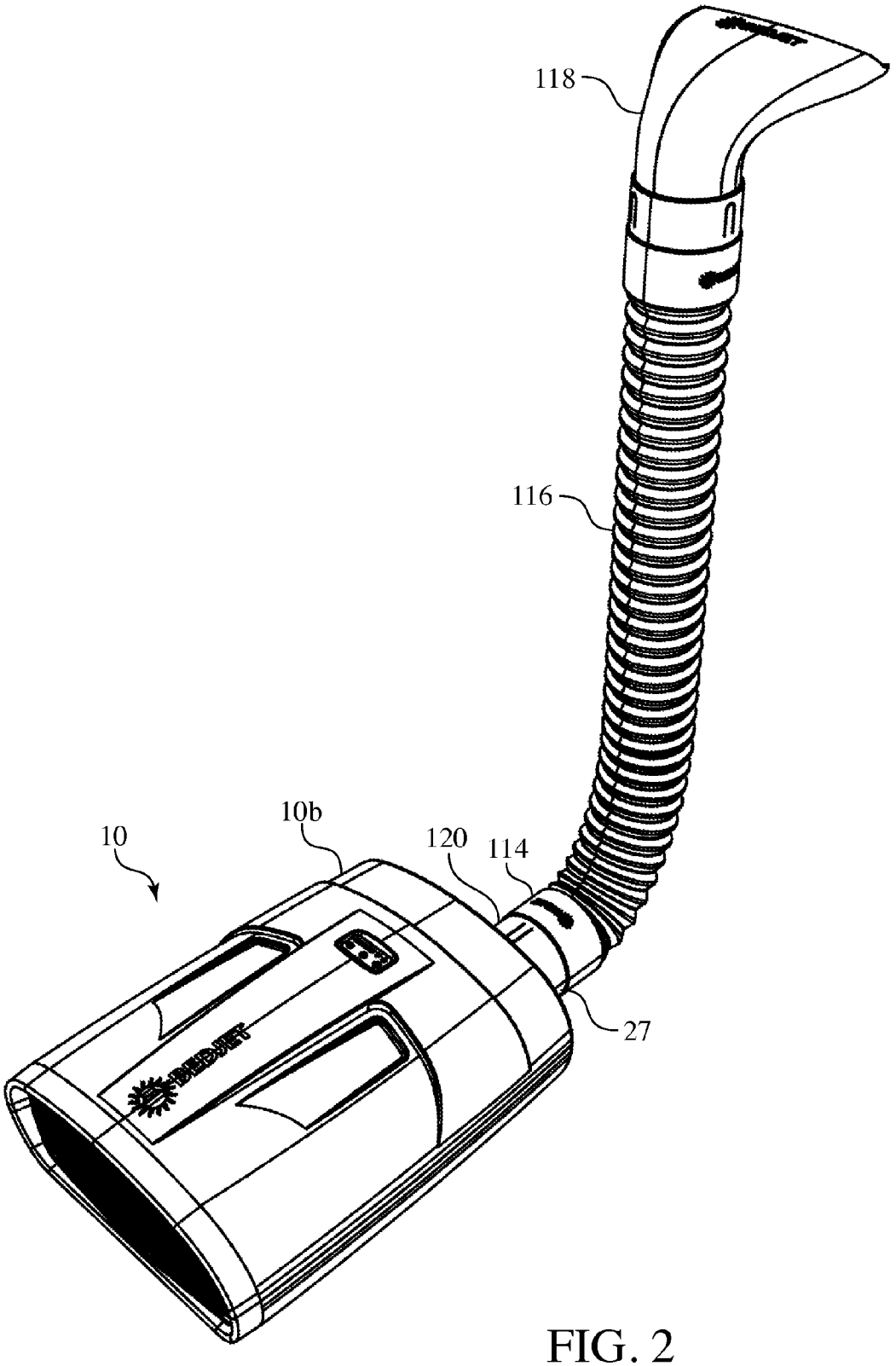
FIG. 2 is an isometric view of an assembly of an air delivery outlet nozzle secured to a distal end of a longitudinally compressible/expandable hose, whose proximal end is secured to a discharge port of the bedding climate control apparatus of FIG. 1.

FIG. 2 shows the bedding climate control apparatus 10 of FIG. 1. Air enters through the intake grille 112 and exits through the cylindrical discharge outlet 120. An end 114 of a hose 116 is mechanically coupled to the cylindrical outlet 120 of the bedding climate control apparatus 10 via any conventional mechanical coupler 27, such as engaging screw threads (not shown). The hose 116 is hollow and serves as an air duct. The distal end of the hose 116 is connected to an inlet opening of an air delivery outlet nozzle 118 through which discharges airflow.

The hose 116 is longitudinally compressible and longitudinally expandable to enable it to bend and yet maintain the dimension of its interior. A steel wire wraps around the length of the hose 116 that resists radial compression or expansion and thus retains the interior dimension regardless of the bending of the hose 116. The hose 116 may be sheathed by a spandex fabric as depicted in U.S. design patent application Ser. No. 29/501,647, whose contents are incorporated herein by reference.

Figure 3:
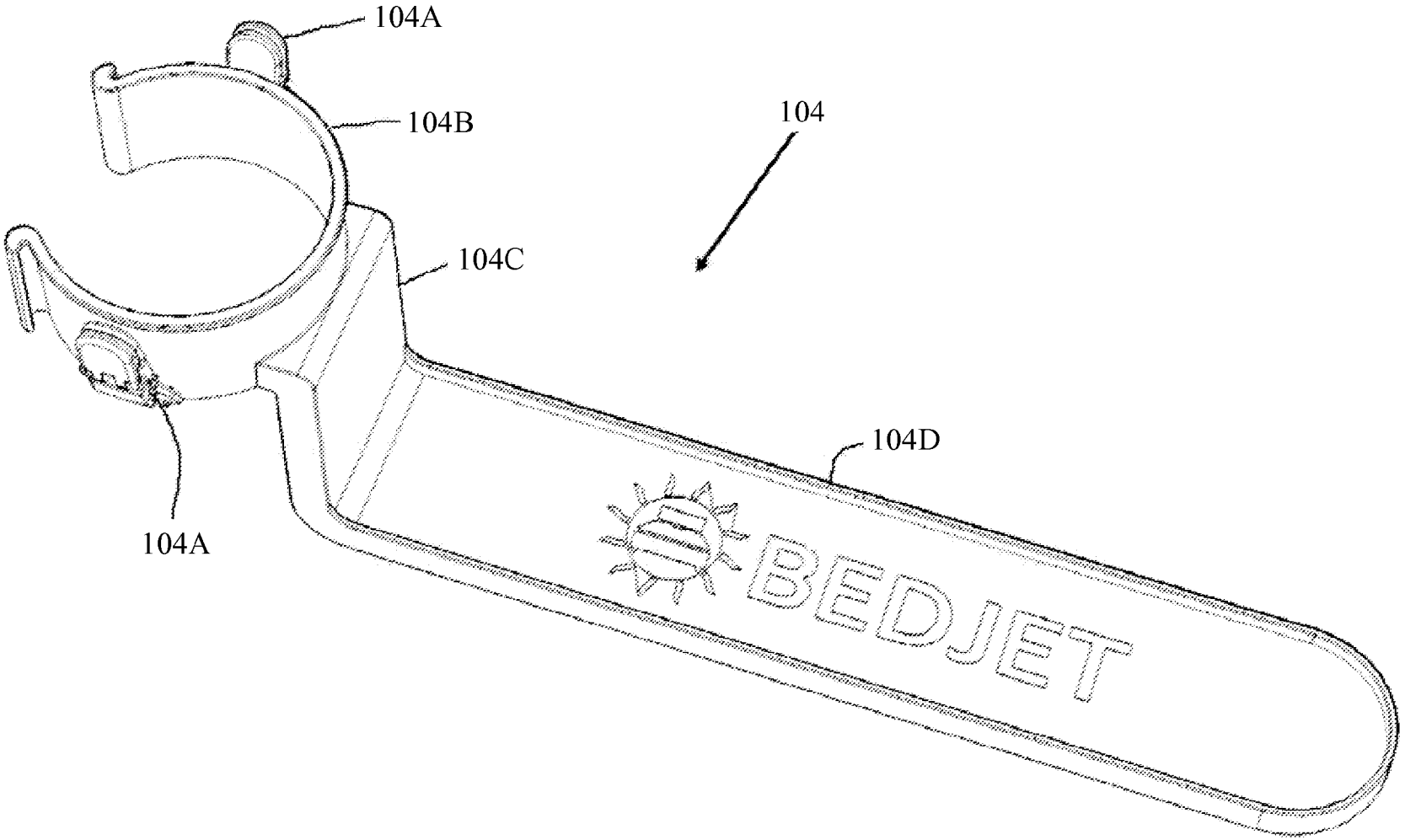
FIG. 3 is an isometric view of the bed sheet retention unit in accordance with the invention.

FIG. 3 shows a bedding sheet retention unit 104 that has means for clamping a bed sheet, namely, two clamps 104A diametrically opposite each other on a horizontally extending grasping portion that also includes means for holding the flexible hose 116, namely, a horizontally extending ring-shaped segment 104B. The flexible hose 116 of FIG. 2 will fit within the internal opening defined by the ring-shaped segment 104B. There is a vertically extending riser segment 104C that rises vertically between and end of a horizontally extending base segment 104D and the ring-shaped segment 104B.

The ring-shaped segment 104 may be closed to grasp about a periphery of the hose to prevent horizontal movement of the flexible hose 116. If the ring-shaped segment 104 is corrugated on its inward facing side, the corrugations are sized to enter grooves on the exterior of the flexible hose 116 to retain the flexible hose 116 in position against relative vertical movement where the retention takes place.

The horizontally extending base segment 104D is elongated and will lie beneath a mattress and provides firm support for the performance of the retaining and holding functions. The vertically extending riser segment 104C extends along an end of the mattress at the foot of a bed. The vertically extending riser segment 104C may be height adjustable by being formed of two sliding elements that slide relative to each other vertically and secured in any relative position with respect to each other in any convention manner that two sliding pieces may be retained in their relative position with respect to each other, such as with a series of holes in one of the sliding pieces and a spring-loaded button in the other that enters into one of the series of holes when aligned and can be urged manually against spring bias to leave the hole to free the sliding pieces from their relative position. Alternatively, the vertically extending riser element 114C may be height adjustable by being constructed in accordance with U.S. utility patent application filed the same day as the present application and entitled "RETENTION UNIT TO GRASP A FLEXIBLE HOSE AND CLAMP ONTO BED SHEETS AND METHODS OF MANUFACTURE AND OPERATION THEREOF", whose subject matter is incorporated herein by reference.

Figure 4:
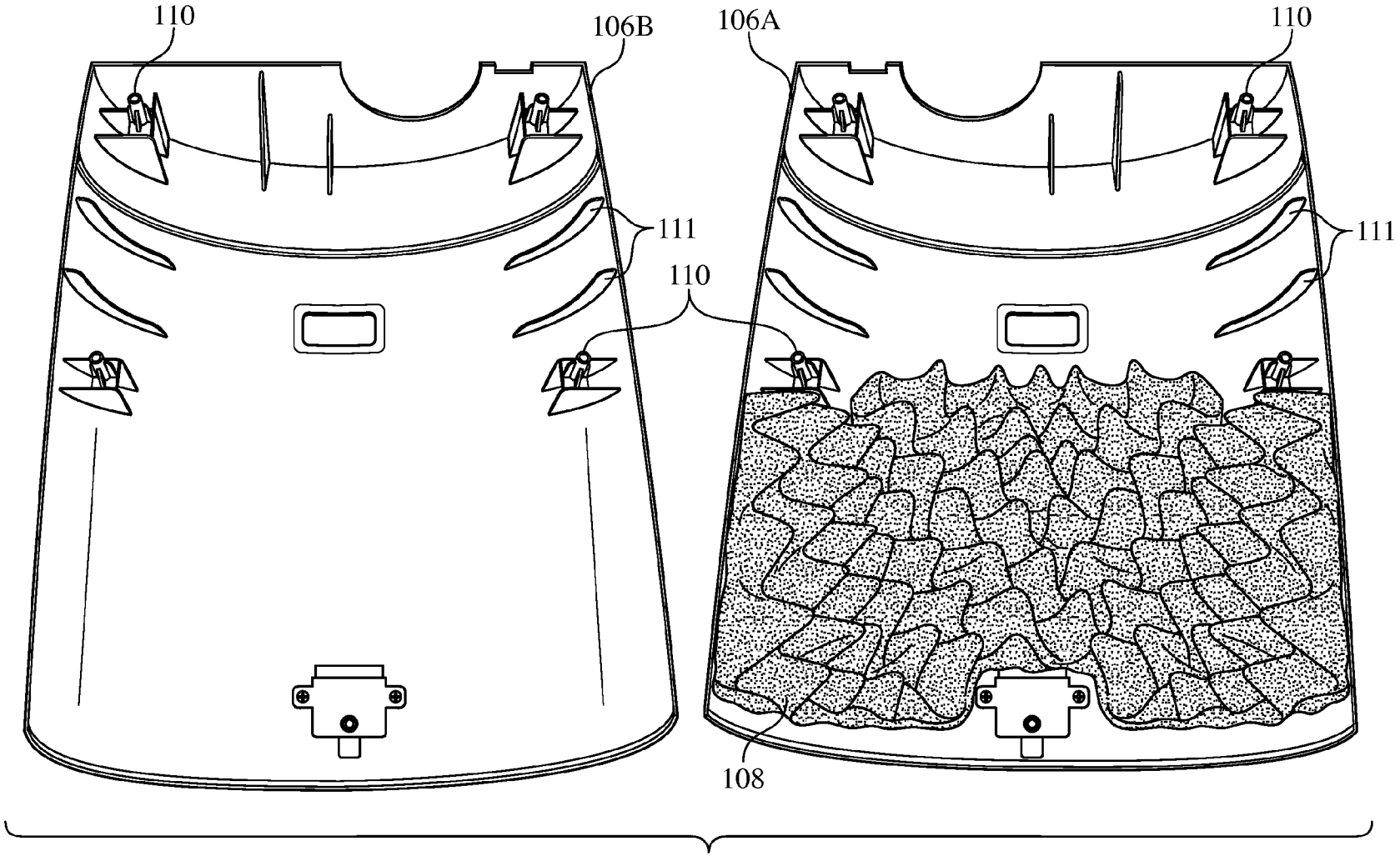
FIG. 4 is an isometric view of the housing of FIG. 1 opened to show the acoustic foil assembled in position in accordance with the invention.

FIG. 4 shows two shell halves 106A, 106B of a housing 106 with one of the two shell halves 106A accommodating acoustic foam 108 in a secure manner within about one half of the interior side of the one of the two shell halves 106A that is closer to the grille 112 (FIG. 1). Thus, air entering the grille 112 strikes the acoustic foam 108 (FIG. 4) and thus there is a dampening effect on the noise otherwise generated from the airflow. It will be understood that the two shell halves 106A, 106B may be secured to each other in any conventional manner, such as via aligned screw threaded fastening elements 110 into which a screw stem is threaded with its head recessed. The two shell halves 106A, 106B may each have supporting ribs 111 to help strengthen them.

Figure 5:
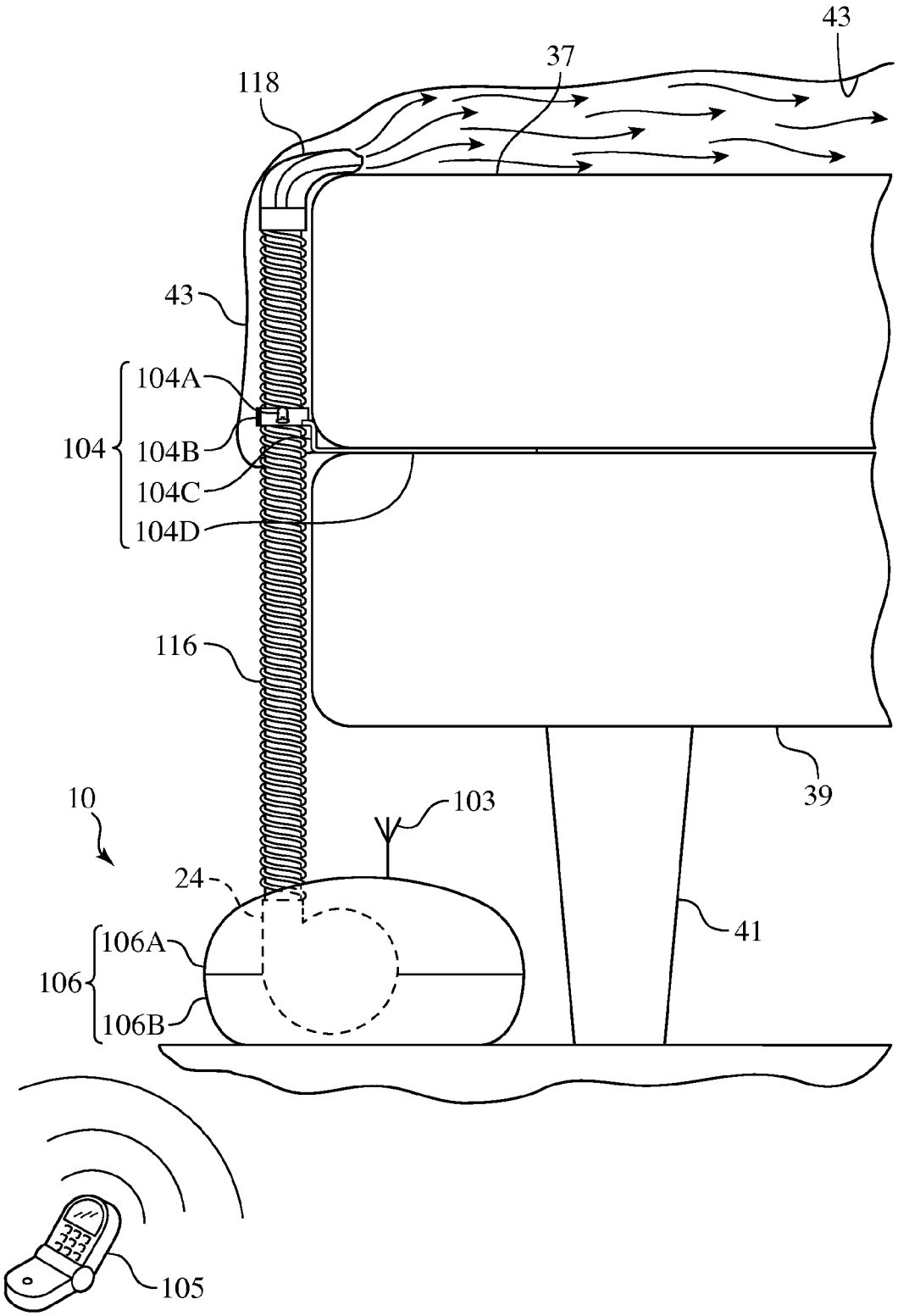
FIG. 5 is a schematic view of the assembly of FIG. 2 and the bed sheet retention unit of FIG. 3 clamped to sheets for a conventional bed having a box spring and mattress.

FIG. 5 shows the bedding climate control apparatus 10 on a floor beneath a bed to blow forced air through the hose 116 and out the air delivery outlet nozzle 118 to enter space between a fitted sheet covered mattress 37 and a bed sheet 43 that overlays the fitted sheet. As a result of this delivery of forced air into the space, the space inflates to increase the volume of the space and thus give rise to an inflated configuration of the bed sheet as shown in FIG. 5. The mattress fitted sheet covers the top, both sides, both ends and a portion of the underside of the mattress by opposite ends of the mattress, The bed is partially shown, with its fitted sheet covered mattress 37 atop a box spring 39 elevated by a frame leg 41. The hose 116 extends from the fan/blower discharge in the bedding climate control apparatus to rise to the air delivery outlet nozzle 118 at the foot of the bed. The bedding retention unit 104 (see FIG. 3) has its horizontally extending base segment 104D between the mattress 37 and the box spring 39. The vertically extending riser segment 104C elevates the horizontally extending ring-shaped segment 104B. The two clamps 104A are clamped to the bed sheet 43. The hose 116 is retained by the horizontally extending ring-shaped segment 104B.

Figure 6:
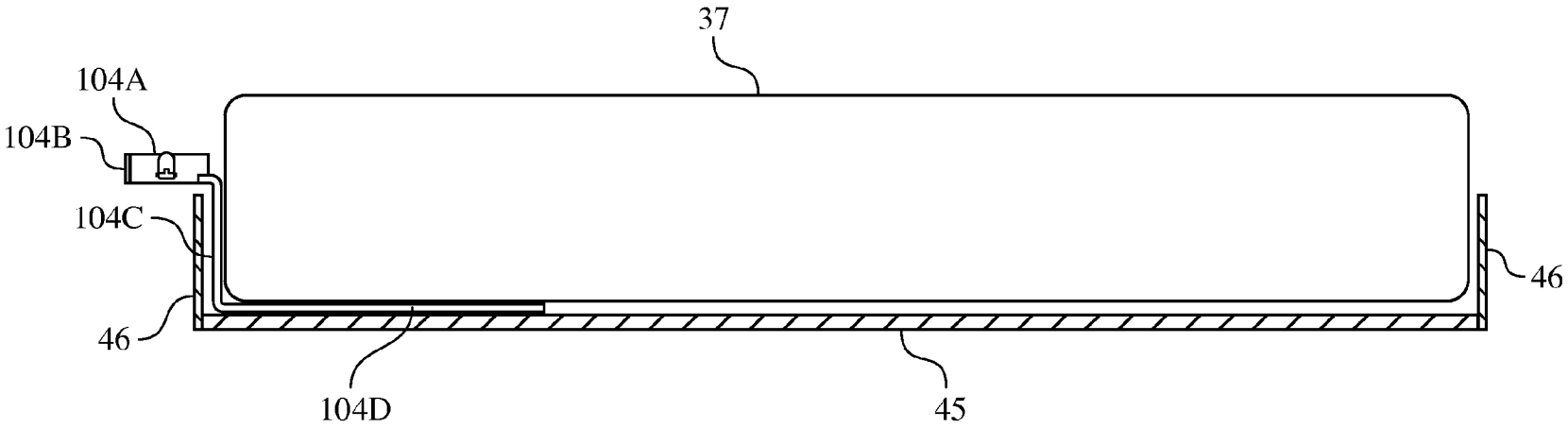
FIG. 6 is a schematic view of the assembly of FIG. 2 with the bed sheet retention unit of FIG. 3 clamped to sheets for a conventional partition bed.

FIG. 6 shows a partial view of a platform bed 45 used in place of the box spring 39 and frame leg 41 of FIG. 5. The mattress 37 rests on a base of the platform bed 45 so that the bedding retention unit 104 is positioned in a like manner except that the horizontally extending base segment 104D lies between the underside of the mattress 37 and the topside of the base of the platform bed 45. Some platform beds have a peripheral lip 46 that extends upward about the periphery of the base. The vertically extending riser segment 104C elevates the horizontally extending ring-shaped segment 104B to an elevation higher than the top of the lip 46 region of the horizontally extending ring-shaped segment 104B that meets the top of the vertically extending riser segment 104C clears the lip 46.

Figure 7:
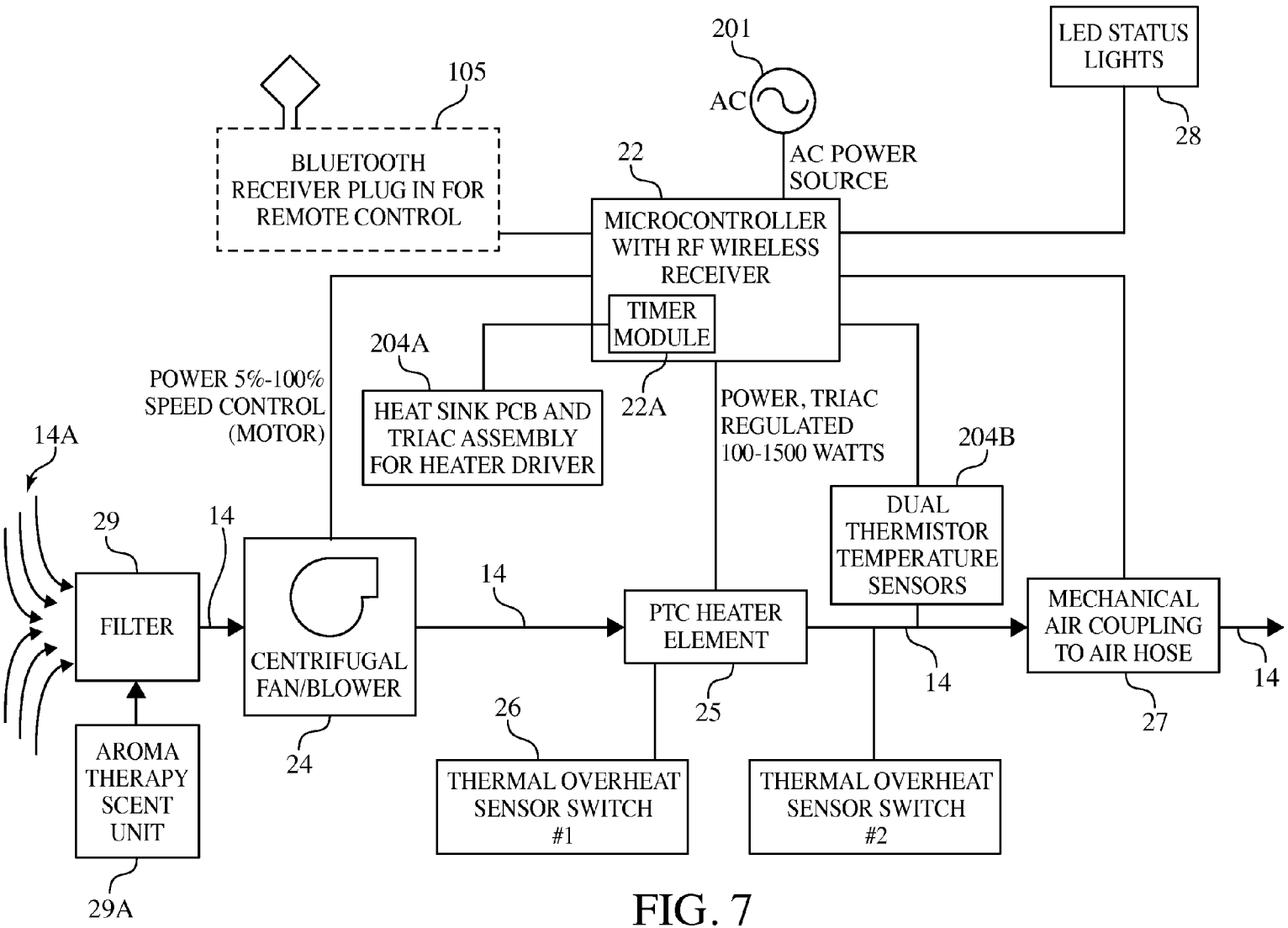
FIG. 7 is a functional block diagram of the bedding climate control apparatus of FIG. 1 and wireless connectivity.

FIG. 7 is a functional block diagram that shows the operative components of the assembly of FIG. 2 and wireless connectivity. A conventional air filter 29 is provided whose purpose is to remove particulates such as dust, lint, and pollen, from the ambient air source 14A.

An aroma therapy optional scent unit 29A, which may be an aromatherapy device, may be provided to administer aroma or scents into the airflow to provide scented or aromatic air that mixes with the filtered air from the filter 29.

The centrifugal fan/blower 24 is operated to suck in filtered airflow 14 from the air source 14A so as to increase the speed of the filtered airflow 14 through the centrifugal fan/blower 24 to a constant volume flow rate by rotating impellers that cause acceleration of the air radially and a change in the direction of the airflow.

A ceramic PTC heater element 25 heats the filtered airflow as it emerges from the centrifugal fan/blower 24 The thermal element may be a 1500 watt positive temperature coefficient (PTC) heater element 25 using ceramic thermal elements sized to 13 Amperes power consumption.

An overheat condition may arise in theory from blockage of the air delivery outlet nozzle 118 if the airflow is left unchecked or from equipment malfunction. This is a reason for detecting the airflow temperature with dual thermistor temperature sensors 204A so that if the temperature gets too close to reaching a an unacceptable overheat condition or possible burn temperature, that the microcontroller will instantly reduce power to the PTC heater element to reduce outlet temperature. In the event the microcontroller does not perform, a thermal overheat sensor switch 26 triggers to shut off power to the PTC heater element 25.

That is, the response of the thermal overheat sensor switch 26 in a sensing that the overheat condition is imminent is to disrupt the main AC power to thwart the overheat condition from being realized. The thermal overheat sensor switch 26 would be triggered to disrupt the main AC power well in advance of the air temperature actually reaching the burn temperature yet higher than the constant air temperature that the bedding climate control apparatus seeks to maintain.

There is a need to disperse built-up body heat and moisture with a dry and refreshing room temperature breeze in between the sheets and over one's body. Such is readily accomplished with the bedding climate control apparatus 10 by blowing forced air between the top sheet and fitted mattress sheet via the hose with the air delivery outlet nozzle with the forced air (unheated by the ceramic thermal element 25). That is, the ceramic thermal element 25 is shut off so as to avoid heating the air passing through.

A microcontroller 22, which is powered by an AC power source 201, controls the fan/blower 24, PTC heater element 25 in accordance with manual controls or remote signals transmitted by a Bluetooth enabled remote device 105 (and/or wireless remote controller) and received via a signal receiver 103, which conveys the received signal to the microcontroller 22 that decodes the received signal. The microcontroller 22 also receives temperature information of the airflow from the dual thermister temperature sensors 204B that sense the temperature of the airflow leaving the centrifugal blower/fan 24. There could be a temperature sensor located at the air delivery outlet nozzle to detect localized high temperature should such arise to trigger microcontroller adjustment of the system, or another thermal overheat sensor switch 26 to cut off power to the PTC heater element 25.

The heat sink PCB (printed circuit board) and TRIAC assembly 204A serves as the heater driver to drive the heater element 25 The heat sink PCB and triac assembly 204A responds to command signals from the microcontroller 22 to vary the output power to drive the PTC heater 25 accordingly to heat at a particular temperature set in accord with the microcontroller 22. The microcontroller 22 issues the appropriate command signals to the heat sink PCB and triac assembly 204A corresponding to the particular temperature based upon inputs from the Bluetooth enabled remote device 105 and/or wireless remote controller and/or the airflow temperature information sensed by the dual thermister temperature sensors 204B.

The microcontroller 22 sends commands to illuminate LED lights 28 to signify the status of operation, including temperature, error code, on/off status. The microcontroller 22 has logic and circuitry necessary for reaching and maintaining a steady or substantially constant airflow temperature for the airflow provided by the fan/blower 24.

The microcontroller 22 includes a timer module 22A that may be set to any suitable time for heating the volume of air, such as changing the temperature setting hourly to a different temperature for heating purposes.

A unique feature of the invention is the ability to raise the temperature of the bedding/sheets of a king or queen sized bed by 20 degrees F. in less than 5 minutes, while maintaining a decibel rating of less than 65 dB measured at 1 meter. This temperature rise gives the user the feeling from the bedding of a "hot towel just out of the dryer" when entering the bed, which provides comfort and delight to the user. It provides heating to more than 75% of the sleeping surface area of king or queen size bedding (including both lower and upper extremity of the user) with a just a very small (less than 8") protrusion into the bottom of the bed by the air delivery outlet nozzle.

Another feature of the invention is supplying room temperature forced air into the bedding (which is at lower temperature than interior of the bedding due to natural human body heat) and thus the person in the bed experiences a sensation of cooling from the forced air.

The invention has special electronics and relays enabling user on/off control and heating/cooling control via a wireless radio frequency remote control. The wireless remote feature combined with the bed heating invention is considered a key unique element of the function of the system and its useability in its application. The invention is intended to be pre-heater for cold winter beds, raising the temperature of the bed over a period of several minutes before the user enters the bed (although it can be used for extended periods at lower operating temperatures while the user in the bed). As such the wireless remote enables to user to activate the invention from other parts of the home while preparing for bed, enabling full pre-heat time.

The invention includes a housing, a high pressure variable speed fan/blower/with brushless DC motor, an electric thermal element, special control electronics and a flexible air output hose or duct with unique air delivery outlet nozzle. The invention housing is located near but not in or attached to the bed and a bed sheet retention unit is inserted into the bottom of bed in between the mattress and the bedding (i.e, the user sleeping layer).

Some of the main features of the invention include:

raising the temperature of the bedding/sheets of a king or queen sized bed by 20 degrees F. in less than 5 minutes to give the user the feeling from the bedding of a "hot towel just out of the dryer" when entering the bed, which provides comfort and delight to the user.

supplying hot air at less than 118 degrees F. to prevent skin burns.

operating a user adjustable auto-shutoff timer that will shut the unit down after between 3 and 10 minutes of operation.

protecting against reaching burn temperature with multiple layers of redundancy, including microcontroller based and mechanical thermal switch over-temperature shut off safety devices.

utilizing the maximum amount of intermittent current allowed from typical 15 amp household bedroom electrical circuit yet sized to enable maximum speed in heating of bedding.

utilizing Nichrome wire or ceramic thermal elements sized at to >11 Amps power consumption.

using several user adjustable heat settings, as well as adjustable air flow settings enabling activation of the unit from a distance separated by several rooms in a house with remove RF wireless controls enabling activation of the unit from smart phones and tablet computers with optional Wi-Fi Bluetooth controls.

heating to more than 75% of the sleeping surface area of king or queen size bedding (including both lower and upper extremity of the user) with a just a very small (less than 8") protrusion into the bottom of the bed of the air delivery outlet duct/flange.

The invention's forced air approach uses a high-pressure variable blower/fan that delivers between 40 to 100 CFM of air flow at minimum 0.3" static pressure, and up to 1" static pressure without stalling. The flow rate is variable by user knob setting to accommodate for different bed sizes and bedding types. This very specific flow rate and static pressure has been determined to be the key element necessary to enable the invention to provide even heating to 75% of the bedding surface area of a king or queen size bed with just a small air outlet duct protrusion into the bottom of the bed.

Using this very specific airflow rate and static pressure delivery range, a tenting effect of the top layer of bedding above the mattress is created. 75% or more of the top layer of bedding covering the mattress surface area is lifted from the mattress by several inches via a cushion or air. This cushion of air layer created in between the bedding and mattress enables the turbulent warm air from the invention to freely distribute the heat throughout the bedding surface area. The unique flow rate and static pressure is also a key element for using normal bedding that may become irregularly bunched up or not be smoothly laid on the bed (i.e., a perfectly made bed).

The invention has electronics and relays enabling user on/off control and heating/cooling control via a wireless radio frequency remote control. The wireless remote feature combined with the bed heating invention is considered a key unique element of the function of the system and its useability in its application. The invention is intended to be pre-heater for cold winter beds, raising the temperature of the bed over a period of several minutes before the user enters the bed (although it can be used while the user in the bed). As such, the wireless remote enables to user to activate the invention from other parts of the home while preparing for bed, enabling full pre-heat time.

The electronics and relays may enable user on/off control and heating/cooling control via wireless Wi-Fi connection or Bluetooth connection or Zigbee Connection, thus enabling smart phone or tablet computers to be utilized as the remote control.

In furtherance of this, the temperature of the forced airflow into the inflated, tented space (between the bed sheet and the fitted mattress sheet) is sensed and transmitted out from the bedding climate control apparatus. The remote control (such as a Bluetooth/Wi-Fi/Zigbee protocol access enabled controller) may be equipped to receive the transmitted sensed temperature over time and undertake an analysis. The analysis may determine that a desired temperature has been reached in which case instructions are transmitted from the remote control to the bedding climate control apparatus to stop the forced airflow. The bedding climate control apparatus is responsive to those instructions to do just that, i.e., shut off the forced airflow. The remote control may be equipped with a display to depict a result of the analysis, such as a graphical representation of a change in the temperature of the inflated, tented space over time.

In addition, the remote control may be programmed or receive instructions from an application that is accessible from the Internet or wireless network to send commands to the bedding climate control apparatus in accordance with settings that were initiated by the user of the remote control. For instance, an increment shut off timer may be set by the user through the programming or via the application accessible on the Internet to provide appropriate settings as to how the bedding climate control apparatus is to attain changes in temperature incrementally over time and shut off the forced airflow as those incremental temperatures are reached over time. The increment shut of timer, whether in the programming or in the application accessible on the Internet, triggers the remote control to send appropriate instructions to the bedding climate control apparatus to carry out the settings over time as they apply. The bedding climate control apparatus responds accordingly by either altering the heating power delivered to the forced airflow or altering a speed of the forced airflow (such as to zero for shut-off or higher or lower that affects the amount of time it will take to reach a desired incremental temperature).

For example, in cooling mode, if the user wanted the temperature of the space to change gradually or rapidly, the speed of the airflow delivery could be varied accordingly to accommodate. On the other hand, in heating mode, if the user wanted the temperature of the space to change gradually or rapidly, then, in addition to varying the speed of the airflow delivery or even to avoid the need to vary the airflow delivery speed, the amount of heat power delivered to the airflow could be varied.

Indeed, the forced airflow may be shut down entirely for a particular period of time after a desired temperature for the inflated, tented space has been reached and resumed as warranted.

The modes of operation of the bedding climate control apparatus may be in accordance with that of U.S. utility patent application filed the same day as the present application and entitled "REMOTE SETTING AND OPERATION OF A BEDDING CLIMATE CONTROL APPARATUS WITH FORCED AIRFLOW FOR HEATING AND VENTILATING", whose contents are incorporated herein by reference.

If desired, the hose 116 of FIG. 2 may be sheathed by a spandex fabric sleeve to soften the appearance at bends of the hose since the bends of the hose are in a compressed state. Such a compressed state arises from the hose being in a bent condition, will be concealed by the fabric sleeve, which takes on a generally cylindrical shape with the hose extending within the confines of the fabric sleeve. Such a sleeved hose may appear as depicted in U.S. design patent application Ser. No. 29/501,647 filed Sep. 5, 2014 and entitled "SLEEVED HOSE", whose contents are incorporated herein by reference.

Figure 8:
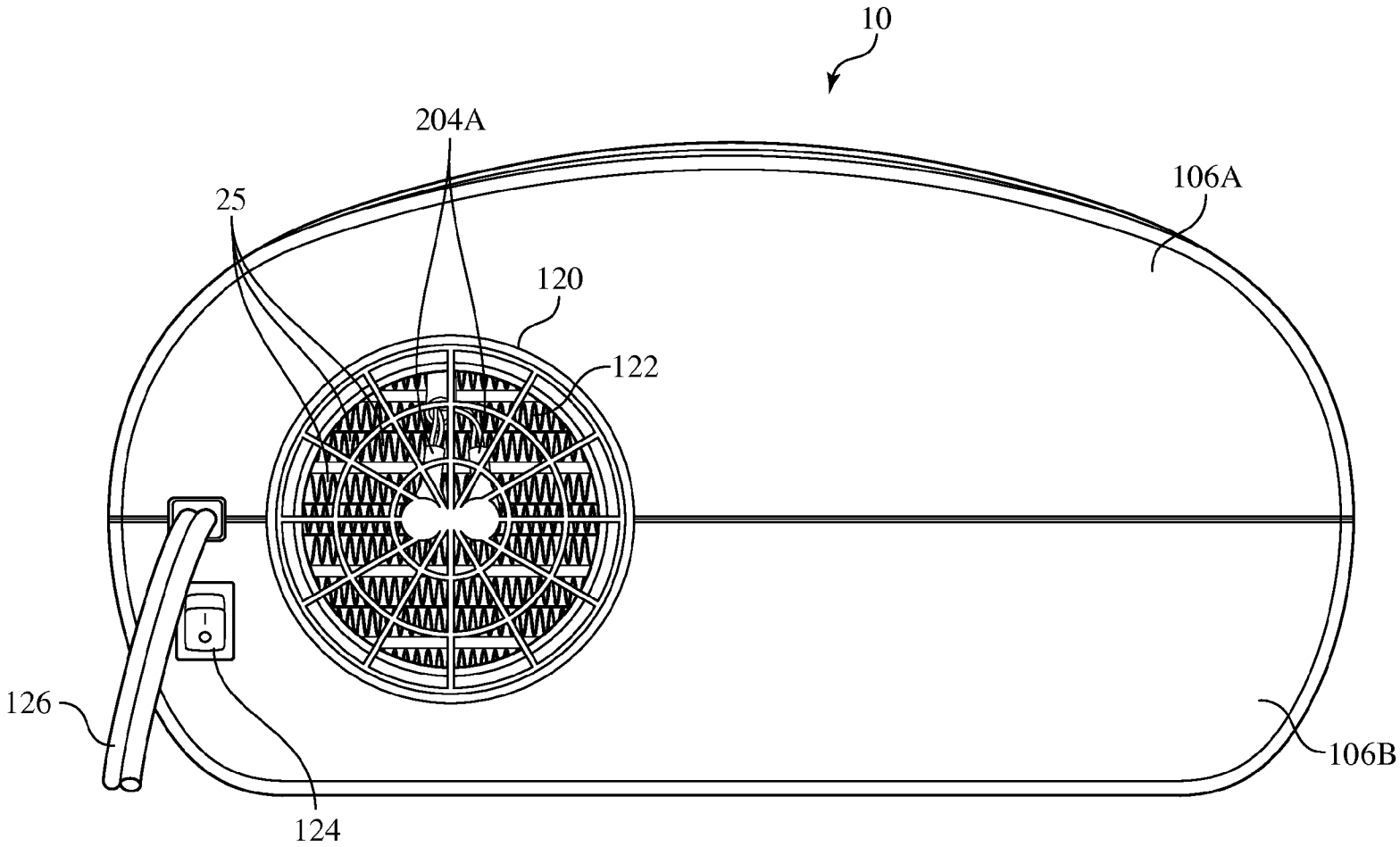
FIG. 8 is an end view of the bedding climate control apparatus housing of the discharge side.

FIG. 8 shows the discharge side of the upper and lower housing 106A, 106B of the bedding climate control apparatus 10. An outlet metal grille guard 122 is within the confines of a projecting cylindrical discharge outlet 120 through which airflow from the fan exits to enter the hose 116 of FIG. 2. The outlet metal grille guard 122 blocks a person's fingers from entering the interior of the housing of the bedding climate control apparatus 10. A manually operated mechanical on-off switch 124 is accessible for turning on or off the bedding climate control apparatus 10, although not shown in FIG. 7. A power cord 116 conveys AC power to the bedding climate control apparatus 10. The manually operated mechanical on-off switch functions to turn on or off power to run the centrifugal blower/fan 24 and PTC heater element 25 of FIG. 7. The dual thermistor temperature sensors 204B of FIG. 7 may be attached to the outlet metal grille 122 to detect the exiting airflow temperature at the outlet metal grille 122.

Figure 9:
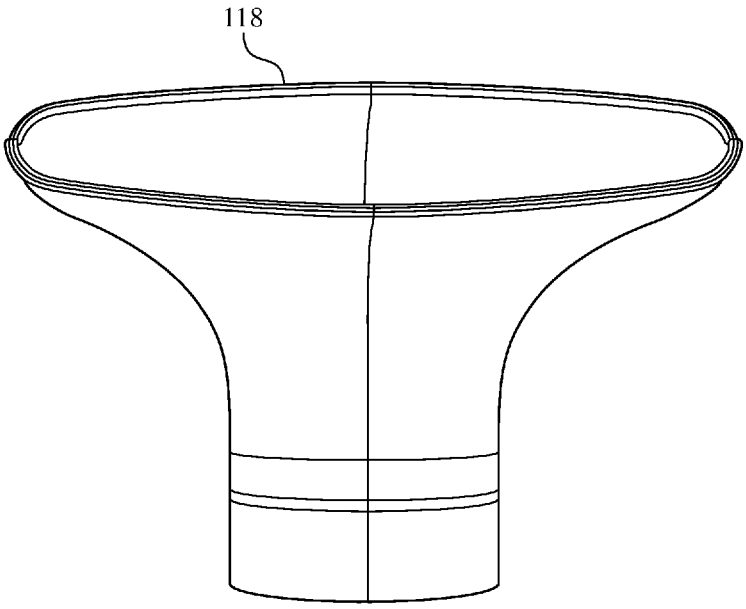
FIG. 9 is an isometric view of the air delivery outlet nozzle in accordance with the invention.

FIG. 9 shows the air delivery outlet nozzle 118 of FIGS. 2 and 5, which is hollow. The structure of the air delivery outlet nozzle 118 corresponds to that depicted in U.S. design patent application Ser. No. 29/501,652, whose contents are incorporated herein by reference.

As should be appreciate, the components of the bedding climate control apparatus that are arranged in succession are the fan or blower, the thermal element, the flexible hose and the air outlet delivery nozzle. Together, the components constitute a means for inflating a space between a fitted mattress sheet covered mattress and a bed sheet through the delivery of forced airflow. The thermal element may impart heating power to raise the temperature of the forced airflow. A change in temperature of the space arises from the delivery of the forced airflow into the space over time (in cooling mode) and the delivery of the forced airflow heated by the thermal element into the space over time (in heating mode).

While the foregoing description and drawings represent the preferred embodiments of the present invention, it will be understood that various changes and modifications may be made without departing from the scope of the present invention.

What is claimed is:

1. A method of operation of a bedding climate control apparatus, comprising the steps of:

inflating a space within bedding over a mattress into an inflated configuration by delivery into the space of forced airflow from the bedding climate control apparatus;

wherein the inflating is carried out with a blower or fan that is oversized for carrying out the inflating;

changing a temperature or humidity of the inflated space over time by effecting the delivery of the forced airflow into the space via components after attaining the inflated configuration;

imparting heating power as warranted to the forced airflow with a thermal element, the components including the blower or fan, the thermal element, and an air conduit the air conduit being constructed in a manner that renders the air conduit compressible longitudinally and expandable longitudinally yet retains an interior hollow dimension substantially intact even as the air conduit compresses and expands longitudinally;

holding the air conduit in position against movement with a retention unit dampening noise from an intake of airflow to the blower or fan with an acoustic foam within a housing of a bedding climate control apparatus, the acoustic foam being arranged in a path of intake of the airflow into the housing to force sound wave deflection off the acoustic foam before the sound waves exits the housing; and based at least partly upon the oversizing of the blower or fan and the dampening, operating the bedding climate control apparatus in manner that generates a noise level at less than 65 decibels at one meter away, delivering the forced airflow the space within the bedding that is over the mattress so as to tent up the bedding and thereby enlarge a dimension of the space in the tent up condition beyond that prior to delivery of the forced airflow.

2. The method of claim 1, wherein operating of the bedding climate control apparatus causes the forced airflow to overcome a pressure drop through the components, the thermal element delivering heat to the forced airflow so that the forced airflow reaches a desired temperature that is no more than substantially 118 degrees Fahrenheit (or 48 degrees Celsius), each of the components being oversized to exceed respective dimensions necessary to enable delivery of the forced airflow at the desired temperature so that the pressure drop is lower than otherwise and the noise level generated is maintained at less than 65 decibels at one meter away.

3. The method of claim 1, further comprising operating a controller wirelessly to issue commands to the bedding climate control apparatus that change an amount of heating power provided by the thermal element to heat the forced airflow, the controller acting in accord with programming of set times for varying the amount of heating power provided by the thermal element.

4. The method of claim 1, further comprising:

issuing commands with each of a wireless controller and a wireless protocol access enabled device, the bedding climate control apparatus being responsive to receipt of the commands from both the wireless controller and the wireless protocol access enabled device at the same time to commence operation of the bedding climate control apparatus in accordance with the commands.

5. The method of claim 1, further comprising:

issuing commands with each of a wireless controller and a wireless protocol access enabled device, the bedding climate control apparatus being responsive to receipt of the commands to carry out a course of action in accord with the commands, the course of action being selected from the group consisting of commencement and termination of the forced airflow, adjusting temperature of the forced airflow, setting a change in temperature of the forced airflow as a function of time over a time interval, recall settings of time, temperature and air flow rate from memory storage and carrying out operation of the bedding climate control apparatus in accord with the retrieved settings.

6. The method of claim 1, wherein the blower or fan discharges the forced airflow through the thermal element to enter a discharge outlet connected to the air conduit, the discharge outlet retaining a metallic grille guard through which the forced airflow passes, further comprising: at least one temperature sensor arranging to sense temperature of the forced airflow at the metallic grille guard.

7. The method of claim 1, wherein the air conduit has an interior cross-section that defines a conduit area of greater than 4.9 square inches, which is oversized for enabling delivery of the forced airflow to inflate the space and contributing to keeping the noise level generated at less than 65 decibels at one meter away from the blower or fan.

8. A method of operation of a bedding climate control apparatus, comprising the steps of:

inflating a space within bedding over a mattress into an inflated configuration by delivery into the space of forced airflow from the bedding climate control apparatus;

changing a temperature or humidity of the inflated space over time by effecting the delivery of the forced airflow into the space via components after attaining the inflated configuration;

imparting heating power as warranted to the forced airflow with a thermal element, the components including the blower or fan, the thermal element, and an air conduit the air conduit being constructed in a manner that renders the air conduit compressible longitudinally and expandable longitudinally yet retains an interior hollow dimension substantially intact even as the air conduit compresses and expands longitudinally;

holding the air conduit in position against movement with a retention unit; and configuring the bedding climate control apparatus to operate the thermal element at a maximum heating power to deliver heat to the forced airflow for a relatively short duration and thereafter operate the thermal element with heat power at a level lower than the maximum heating power to deliver heat to the forced airflow for a relatively long duration that is a longer time interval than is the relatively short duration.

9. The method of claim 8, wherein the bedding climate control apparatus effects operation of the thermal element in response to receipt of appropriate command signals indicative of heat or cool modes, further comprising an auto-shutoff timer configured to be advanced with different time increments or maximum time intervals depending upon the appropriate command signal received that is indicative of the heat or cool modes.

10. A method of operation of a bedding climate control apparatus, comprising the steps of:

inflating a space within bedding over a mattress into an inflated configuration by delivery into the space of forced airflow from the bedding climate control apparatus;

changing a temperature or humidity of the inflated space over time by effecting the delivery of the forced airflow into the space via components after attaining the inflated configuration;

imparting heating power as warranted to the forced airflow with a thermal element, the components including the blower or fan, the thermal element, and an air conduit, the air conduit being constructed in a manner that renders the air conduit compressible longitudinally and expandable longitudinally yet retains an interior hollow dimension substantially intact even as the air conduit compresses and expands longitudinally;

holding the air conduit in position against movement with a retention unit; and arranging the retention unit to retain the bedding sheet in place, the retention unit including a grasping portion, a riser portion and a support portion, said grasping portion having means for clamping the bedding sheet and means for holding onto the air conduit, said support portion including an elongated support element that extends beneath a mattress horizontally, the riser portion including a riser that extends vertically between an end of the elongated support element and the grasping portion.

11. The method of claim 10, further comprising:

heating the forced airflow with the thermal element that is a PTC thermal element; and keeping a maximum surface temperature of the TRC thermal element below 200 degrees Celsius under any condition of the changing of the temperature or humidity as a consequence of oversizing the PTC thermal element accordingly beyond that necessary to heat the forced airflow to the changed temperature or humidity.

12. The method of claim 10, further comprising:

mounting an air delivery outlet nozzle to the air conduit; and swiveling the air delivery outlet nozzle between different orientations relative to the air conduit.

13. The method of claim 12, further comprising:

stretching and compressing the flexible hose and the retention unit and keeping the air delivery outlet nozzle in a fixed spatial position during the stretching and compressing of the flexible hose and the retention unit without coming loose.

14. The method of claim 10, further comprising:

stretching a stretchable fabric cover about a length of a portion of the air conduit, the portion of the air conduit being longitudinally compressible and longitudinally expandable.

15. A bedding climate control apparatus, comprising:

means for inflating a space within bedding that is over a mattress into an inflated configuration by delivery into the space of forced airflow;

means for changing a temperature or humidity of the inflated space over time by effecting the delivery of the forced airflow into the space via components after attaining the inflated configuration;

means for imparting heating power as warranted to the forced airflow with a thermal element, the components including the a blower or a fan, the thermal element, and an air conduit, the air conduit being constructed in a manner that renders the air conduit compressible longitudinally and expandable longitudinally yet retains an interior hollow dimension substantially intact even as the air conduit compresses; and means for holding the air conduit in position against movement with a retention unit;

wherein the bedding climate control apparatus is configured to operate the thermal element at a maximum heating power to deliver heat to the forced airflow for a relatively short duration and thereafter operate the thermal element with heat power at a level lower than the maximum heating power to deliver heat to the forced airflow for a relatively long duration that is a longer time interval than is the relatively short duration.

16. The apparatus of claim 15, wherein the means for imparting heating power as warranted to the forced airflow with a thermal element is operative in response to receipt of appropriate command signals indicative of heat or cool modes, further comprising:

an auto-shutoff timer configured to be advanced with different time increments depending upon the appropriate command signal received that is indicative of the heat or cool modes.

17. The apparatus of claim 15, wherein the bedding climate control apparatus includes a blower or fan that discharges the forced airflow through the thermal element to enter a discharge outlet connected to an air conduit, the discharge outlet retaining a metallic grille guard through which the forced airflow passes, further comprising at least one temperature sensor arranging to sense temperature of the forced airflow at the metallic grille guard.

18. A bedding climate control apparatus, comprising:

means for inflating a space within bedding that is over a mattress into an inflated configuration by delivery into the space of forced airflow from the bedding climate control apparatus;

means for changing a temperature or humidity of the inflated space over time by effecting the delivery of the forced airflow into the space via components after attaining the inflated configuration;

means for imparting heating power as warranted to the forced airflow with a thermal element, the components including the blower or fan, the thermal element, and an air conduit, the air conduit being constructed in a manner that renders the air conduit compressible longitudinally and expandable longitudinally yet retains an interior hollow dimension substantially intact even as the air conduit compresses; and means for holding the air conduit in position against movement with a retention unit, wherein the retention unit includes a grasping portion, a riser portion and a support portion, said grasping portion having means for clamping the bedding sheet and means for holding onto the air conduit, said support portion including an elongated support element that extends beneath a mattress horizontally, the riser portion including a riser that extends vertically between an end of the elongated support element and the grasping portion.

19. A method of operation of a bedding climate control apparatus, comprising the steps of:

inflating a space within bedding over a mattress into an inflated configuration by delivery into the space of forced airflow from the bedding climate control apparatus;

changing a temperature or humidity of the inflated space over time by effecting the delivery of the forced airflow into the space via components after attaining the inflated configuration;

imparting heating power as warranted to the forced airflow with a thermal element, the components including the blower or fan, the thermal element, and an air conduit the air conduit being constructed in a manner that renders the air conduit compressible longitudinally and expandable longitudinally yet retains an interior hollow dimension substantially intact even as the air conduit compresses and expands longitudinally;

holding the air conduit in position against movement with a retention unit; and dampening noise from an intake of the forced airflow to a blower or fan with an acoustic dampening material within a housing of a bedding climate control apparatus, the acoustic dampening material being arranged in a path of intake of the forced airflow into the housing to force sound wave deflection off the acoustic dampening material before the sound waves exit the housing.

20. The method of claim 19, further comprising:

sensing temperature of the forced airflow; and responding to the sensed temperature to vary heat delivery from the thermal element and to vary a speed of delivery of the forced air flow to affect an amount of time needed to reach a desired temperature of the inflated space.

21. A bedding climate control apparatus, comprising:

means for inflating a space within bedding that is over a mattress into an inflated configuration by delivery into the space of forced airflow from the bedding climate control apparatus;

means for changing a temperature or humidity of the inflated space over time by effecting the delivery of the forced airflow into the space via components after attaining the inflated configuration;

means for imparting heating power as warranted to the forced airflow with a thermal element, the components including the blower or fan, the thermal element, and an air conduit, the air conduit being constructed in a manner that renders the air conduit compressible longitudinally and expandable longitudinally yet retains an interior hollow dimension substantially intact even as the air conduit compresses;

means for holding the air conduit in position against movement with a retention unit; and means for dampening noise from an intake of the forced airflow to a blower or fan with an acoustic dampening material that is within a housing of a bedding climate control apparatus, the acoustic dampening material being arranged in a path of the intake of the forced airflow into the housing to force deflection off the acoustic dampening material before the forced airflow exits the housing.

22. The apparatus of claim 21, further comprising:

means for sensing temperature of the forced airflow; and means responsive to the sensed temperature to vary heat delivery from the thermal element and to vary a speed of delivery of the forced air flow to affect an amount of time needed to reach a desired temperature of the inflated space.

* * * * *